US011348703B2

(12) United States Patent
Hong et al.

(10) Patent No.: US 11,348,703 B2
(45) Date of Patent: May 31, 2022

(54) TUNABLE SIDE-BOUNCE X-RAY MONOCHROMATOR

(71) Applicant: UCHICAGO ARGONNE, LLC, Chicago, IL (US)

(72) Inventors: Hawoong Hong, Naperville, IL (US); Jonathan Z. Tischler, Lisle, IL (US); Xianbo Shi, Naperville, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 1 day.

(21) Appl. No.: 17/022,831

(22) Filed: Sep. 16, 2020

(65) Prior Publication Data

US 2022/0084711 A1 Mar. 17, 2022

(51) Int. Cl.
*G21K 1/06* (2006.01)

(52) U.S. Cl.
CPC ..... *G21K 1/062* (2013.01)

(58) Field of Classification Search
CPC .... G01N 23/00; G01N 23/20008; G21K 1/00; G21K 1/06; G21K 1/062
See application file for complete search history.

(56) References Cited

U.S. PATENT DOCUMENTS 4,365,156 A * 12/1982 Golovchenko ..... G21K 1/06 356/333
8,767,915 B2 * 7/2014 Stutman ..... A61B 6/5235 378/62

OTHER PUBLICATIONS

Als-Nielsen et al., Synchrotron X-ray diffraction study of liquid surfaces, Nuclear Instruments and Methods, 208:545-8 (1983).
Borland et al., The Upgrade of the Advanced Photon Source, 9th International Particle Accelerator Conference, IPAC2018, Vancouver, British Colombia, Canada, 6 pp. (2018).
Golovchenko et al., X-ray monochromator system for use with synchroton radiation sources, Review of Scientic Instruments, 52:509 (1981).
Mills et al., A separated crystal, fixed-exit monochromator for x-ray synchrotron radiation, Nuclear Instruments and Methods, 208:341-347 (1983).
Rebuffi et al., *ShadowOui*: a new visual environment for X-ray optics and synchrotron beamline simulations, Journal of Synchrotron Radiation, 23:1357-67 (2016).
(Continued)

*Primary Examiner* — Jurie Yun
(74) *Attorney, Agent, or Firm* — Marshall, Gerstein & Borun LLP

(57) ABSTRACT

Monochromators selectively transmit a narrow band of wavelengths of radiation from a broader band of wavelengths for use in a variety of applications and industries. Disclosed is a method and system for fixed-exit angle tunable monochromator. The system includes a first diffraction element configured to reflect an input beam incident on a surface of the first diffraction element. The input beam has an input beam vector and the first diffraction element is rotatable about the input beam vector. The system further includes a second diffraction element configured to reflect the beam as an output beam having a fixed beam exit angle. The beam is incident on a surface of the second diffraction element and the reflected beam has a reflected beam vector. The second diffraction element is rotatable about both the input beam vector and the reflected beam vector.

20 Claims, 9 Drawing Sheets

(56) References Cited

OTHER PUBLICATIONS

Rebuffi et al., OASYS (OrAnge SYnchrotron Suite): an open source graphical environment for x-ray virtual experiments, Proceedings of SPIE 10388, Advances in Computational Methods for X-Ray Optics IV, 103880S (Aug. 23, 2017).
Sanchez del Rio et al., *SHADOW3*, a new version of the synchrotron X-ray optics modelling package, J. Synchrotron Radiation, 18:708-16 (2011).

* cited by examiner

| Energy (keV) | 2Θ | $\gamma$ | $\alpha$ | $\beta$ |
|---|---|---|---|---|
| 5 | 74.043 | 23.13 | 3.354 | 24.070 |
| 10 | 35.043 | 23.13 | 16.965 | 40.871 |
| 15 | 23.157 | 23.13 | 28.584 | 61.302 |
| 25 | 13.833 | 23.13 | 56.206 | 113.962 |

FIG. 6

| Energy (keV) | $K_V$ | $I_O$ (ph/s/0.1%BW) | BW (eV) | Total flux (ph/s) | Size H (mm) | Size V (mm) | Flux density (ph/s/mm$^2$) |
|---|---|---|---|---|---|---|---|
| 5 | 2.322 | $9.48 \times 10^{14}$ | 0.28 | $4.8 \times 10^{12}$ | 0.75 | 0.68 | $9.3 \times 10^{12}$ |
| 15 | 2.322 | $5.33 \times 10^{14}$ | 0.94 | $2.5 \times 10^{12}$ | 0.45 | 0.36 | $1.5 \times 10^{14}$ |
| 10 | 2.315 | $9.82 \times 10^{12}$ | 0.89 | $4.3 \times 10^{12}$ | 0.67 | 1.02 | $6.3 \times 10^{12}$ |

FIG. 7E

| Energy (keV) | $P_I$ | $\beta$-$\beta'$-$\alpha$ | $P_{SCM}$ | $2\Theta$ |
|---|---|---|---|---|
| 5 | 0.893 | 14.280 | 0.275 | 74.044 |
| 10 | 0.948 | 1.396 | 0.819 | 35.043 |
| 15 | 0.956 | 0.242 | 0.919 | 23.157 |
| 25 | 0.959 | -0.028 | 0.971 | 13.833 |

FIG. 8

TUNABLE SIDE-BOUNCE X-RAY MONOCHROMATOR

STATEMENT REGARDING FEDERALLY SPONSORED RESEARCH OR DEVELOPMENT

This invention was made with government support under Contract No. DE-AC02-06CH11357 awarded by the United States Department of Energy to UChicago Argonne, LLC, operator of Argonne National Laboratory. The government has certain rights in the invention.

FIELD OF THE DISCLOSURE

The present disclosure relates to methods and systems for a radiation monochromator, and specifically, for a tunable monochromator having a fixed exit angle for radiation at different energies.

BACKGROUND

A monochromator is an optical device that selectively transmits a narrow band of wavelengths of radiation from a broader band of wavelengths. Monochromators are useful across a broad range of research and industries including emission spectrometry, absorption spectrometry, circular dichroism spectrometry, radiation absorption detection, fluorescence intensity measurements, and in radiation beamlines. Monochromators typically rely on optical dispersion or diffraction to spatially separate the wavelengths of radiation which can then be further spatially filtered using an exit slit to select a wavelength, or band of wavelengths.

Side-bounce monochromators are often implemented in x-ray beamlines to select x-ray energies for optical setups and experiments. Typical monochromators on side-bounce beamlines have fixed output angles which are often required for efficient operation of a monochromator in a beamline. Fixed-angle side-bounce beamlines utilize a single crystal which only allows access to a fixed, narrow-band of radiation energies. Some implementations of fixed-angle monochromators employ multiple diffraction elements having different diffraction grating periods to provide access to multiple radiation energies, although, the various energies available are discrete bands and are not tunable across a broad range of radiation energies. Attempts to fabricate tunable side-bounce monochromators have resulted in a variable output angle which requires reconfiguration of radiation sources and targets of the radiation (e.g., a chemical sample, optical setup, etc.), which is not practical in many research settings and for radiation sources that supply radiation to multiple labs or setups (e.g., in a beamline). Additionally, tunable monochromators often exhibit high polarization dependent losses. Therefore, many areas of research and industries would benefit from a fixed-angle, tunable monochromator for use in beamlines and other devices and setups.

SUMMARY OF THE DISCLOSURE

A beam steering system and method for a fixed-exit angle tunable monochromator includes a first diffraction element configured to reflect an input beam incident on a surface of the first diffraction element. The input beam has an input beam vector and the first diffraction element is rotatable about the input beam vector. The reflected beam is directed to a second diffraction element. The second diffraction element is configured to reflect the beam as an output beam having a beam exit angle. The reflected beam is incident on a surface of the second diffraction element and the reflected beam has a reflected beam vector. The second diffraction element is rotatable about both the input beam vector and the reflected beam vector.

BRIEF DESCRIPTION OF THE DRAWINGS

FIG. 6 is a table of angular values $\alpha$ and $\beta$ for a diamond based tunable monochromator configuration with various output beam energies having a fixed exit angle of 23.13 degrees.

FIG. 7E is a table of resulting parameter values including the flux, intensity, and spatial distribution of the simulated beams of FIGS. 7A-7D including parameters for a 10 keV beam.

FIG. 8 is a table of polarization factors and total rotation values for a dual crystal monochromator and a typical single crystal monochromator.

DETAILED DESCRIPTION

Figure 1A:
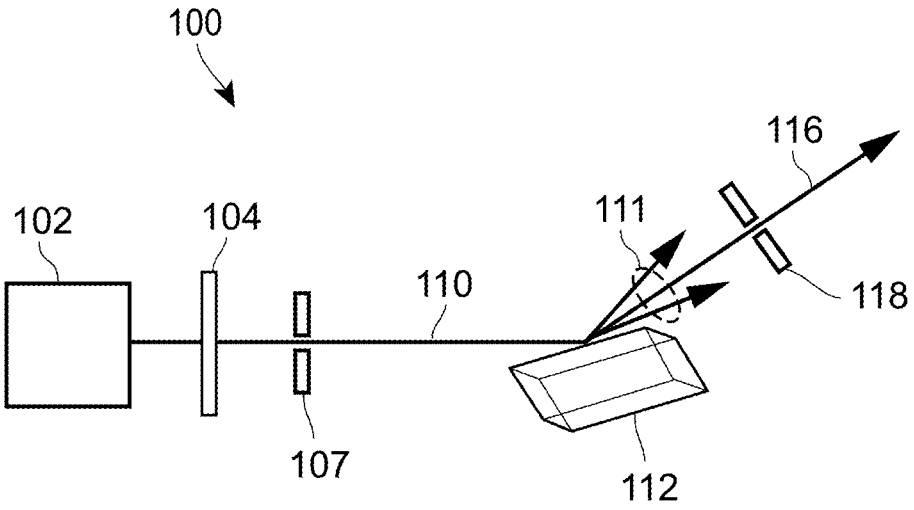
FIG. 1A (Prior Art)
FIG. 1A illustrates an example of a single crystal side-bounce monochromator.

Monochromators rely on chromatic dispersion (e.g., by a prism or other dispersion optical element or material) or diffraction (e.g., by a grating, crystal, multilayer, or other diffractive element). Chromatic dispersion based monochromators are typically wavelength dependent in operation and may spatially disperse some energies of radiation more than others. In diffraction-based monochromators, the spatial separation of different radiation energies depends on the grating spacing and geometry of the optical elements. Additionally, diffraction based monochromators are typically less temperature dependent, and a higher polarization dependent loss due to the required diffraction angles.

Disclosed herein is a system and method for a tunable side-bounce monochromator that has a fixed exit angle. The monochromator described utilizes two diffraction gratings that are reoriented and repositioned to tune the energy of the output radiation across a broad band from 3 keV to 30 keV while maintaining a fixed exit angle. Additionally, the system and method disclosed reduce the polarization dependent loss of the monochromator as compared to typical monochromators. The system and method described herein are useful across a number of industries and applications including for tuning the output radiation energy of an x-ray beamline. For example, side-bounce beamlines with a fixed beam exit angle, also referred to herein as a fixed exit angle, are typically limited to operating with one selected energy or a fixed narrow range of output energies. A fixed exit angle tunable monochromator would be beneficial for side-bounce beamlines to allow for more robust operation of the beamline. For example, a fixed exit angle tunable monochromator allows for more compact arrangement of a beamline requiring less space that other monochromator technologies. The more compact arrangement allows for flexibility in the requirements of the beamline housing and physical space, and increases productivity by allowing for tuning of the energy of an output beam without the need for rearranging large components of the monochromator or other hardware. Additionally, multiple labs or instruments that utilize the same beamline as a radiation source may each have their own monochromator, and it may therefore be useful for each instrument to have a tunable monochromator that maintains a fixed exit angle, independent of the other setups and monochromators. As such, a single beamline may be able to independently provide individual instruments with radiation having ranges of desired energies.

In electromagnetics, it is common to distinguish a frequency, wavelength, energy, and color of electromagnetic radiation. Each of these four characteristics is related to the other three. For example, the wavelength, in nanometers (nm), and frequency, in hertz (Hz), for a specified electromagnetic radiation are inversely proportional to each other. Similarly, the energy, in electron-volts (eV) or joules (J), of electromagnetic radiation is proportional to the frequency of that radiation. Therefore, for a given radiation at a given frequency, there is a single corresponding wavelength and energy.

The fourth of the aforementioned characteristics, color, typically represents a group or band of frequencies or wavelengths. For example, the color blue is commonly defined as electromagnetic radiation with a wavelength from 450 nm to 495 nm. This wavelength band also corresponds to frequencies from 606 THz to 668 THz, and energies of 2.5 to 2.75 eV. The color blue, then, is any radiation with one of those wavelengths, or radiation with multiple wavelengths in that band. Therefore, the term color may refer to one specific wavelength, or a band of wavelengths. Some areas of trade in electromagnetics prefer the use of one of the four terms over the others (e.g., color and wavelength are preferred when discussing optical filters, whereas frequency and energy are preferred when optical excitation processes). Therefore, the four terms may be understood to be freely interchangeable in the following discussion of electromagnetic radiation and monochromator devices. Although all four terms, color, frequency, wavelength, and energy are related, the terms wavelength and energy will be commonly used herein and should be understood to be interchangeable given their respective definitions as is commonly known in the field.

FIG. 1A illustrates an example single side-bounce monochromator 100 having a radiation source 102, filters 104, and beam optics 107 for forming the input beam 110. The input beam 110 is incident on a diffraction element 112, which simultaneously reflects and spatially disperses the energies of the radiation of the input beam 110 to form multiple output beams 111. A spatial filter 118 may then be used to transmit a narrow band of energies of radiation of the output beams 111 to generate the tuned output beam 116, with the output beam 116 having a subset of radiation energies of the input beam 110. While described in instances herein as a crystal monochromator, any diffraction element of the described monochromators may be a crystal, multilayer material, diffraction grating, or another element capable of diffracting radiation. Further, any lists provided herein are for exemplary purposes and are not intended to be limiting.

Figure 1B:
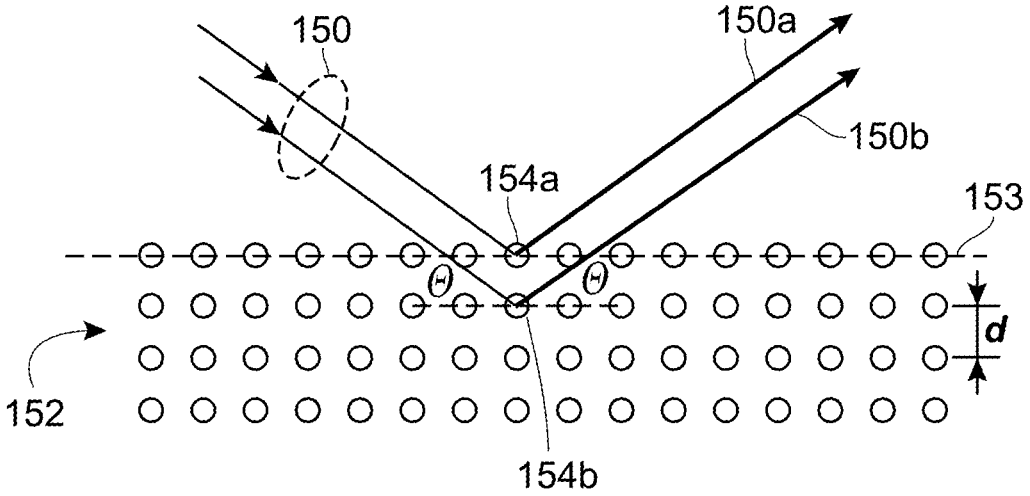
FIG. 1B (Prior Art)
FIG. 1B is a diagram that illustrates the concept of Bragg's Law as utilized in a crystal based monochromator.

Typically, for beamlines, a crystal is employed as the diffraction element 112. Due to the periodic structure of a crystal, the crystal diffracts the input beam 110 according to Bragg's Law. FIG. 1B is a diagram that illustrates the concept of Bragg's Law as utilized in a crystal based monochromator. An input beam 150 having a wavelength or band of wavelengths, A, is incident on a surface 153 of a crystal 152. A first portion of radiation of the input beam 150 reflects off of a first atom 154*a* at the surface 153 of the crystal 152 to form a first reflected beam 150*a*. The first reflected beam 150*a* is reflected off of the atom at an angle θ. A second portion of radiation reflects off of a second atom 154*b* that is within the crystal 152, below the surface 153 of the crystal 152, to form a second reflected beam 150*b*. The second reflected beam 150*b* is also reflected at the angle θ. The first and second reflected beams 150*a* and 150*b* are then out of phase with the phase difference determined by a distance of the atomic crystal lattice, d. The first and second reflected beams 150*a* and 150*b* interfere constructively and destructively, and the spatial dispersion of the constructive interference of the wavelengths of the first and second reflected beams 150*a* and 150*b* can be determined by Bragg's Equation:

$$2d^{*}\sin\theta = n\lambda \qquad \text{EQ. 1}$$

where the left side of the equation, 2d*sin(θ), represents the total phase difference between the first and second reflected beams 150*a* and 150*b*, and n is a positive integer representing the "order of reflection." Due to the periodic nature of an electromagnetic wave, constructive interference occurs maximally when the difference of the distance traversed by the first and second reflected beams 150*a* and 150*b* (i.e., the left side of the Bragg Equation) is equal to a multiple of the wavelength (i.e., the right side of the Bragg equation). Therefore, the Bragg Equation defines the crystal lattice distance, angle of reflection, and wavelength combinations for a given system that allow for constructive interference of wavelengths, or bands of wavelengths, of a monochromator. An energy band of constructively interfering radiation may then be provided by a diffraction based monochromator.

The angle θ may be tuned to change the individual output beams' 111 wavelengths that result in constructive interference. Although, any change in the angle θ inherently causes a change in the exit angle of the output radiation. Additionally, the lattice distance d limits the range of tunable radiation energies, and typically, monochromators are very lossy at large reflectance angles due to polarization effects. Lower energy output beams 111 require greater diffraction angles, which results in greater polarization dependent loss as lower energies. As such, single crystal monochromators are not viable for generating a wide-range of tunable energies having a fixed output angle.

Described herein is a system and method for a side-bounce x-ray monochromator that utilizes two diffraction elements configured to rotate about a plurality of axes to (i) allow for tunability of the output radiation energy of the monochromator, and (ii) maintain a fixed exit angle for the different output radiation energies. The two-diffraction element system described allows for tunability of the radiation over a wide range of photon energies. Whereas some monochromators employ different types of crystals to output discrete energies or energy bands, the disclosed monochromator is continuously tunable over a wide energy band. Additionally, the disclosed two-diffraction element monochromator reduces the polarization dependent losses by reducing the required angles of reflection of the diffraction elements. The disclosed system and method enables a wide range of x-ray energies to be available from side-bounce beamlines, and enables resonant experiments to be conducted using beamline setups, which increases the utility of side-bounce beamlines and could potentially lead to more widespread use of side-bounce beamlines. Additionally, a side-bounce monochromator typically allows for a more compact arrangement of a beamline than other monochromators. Therefore a tunable side-bounce monochromator, as described herein, may further save time, money, and floor space as compared to other monochromator technologies.

Figure 2:
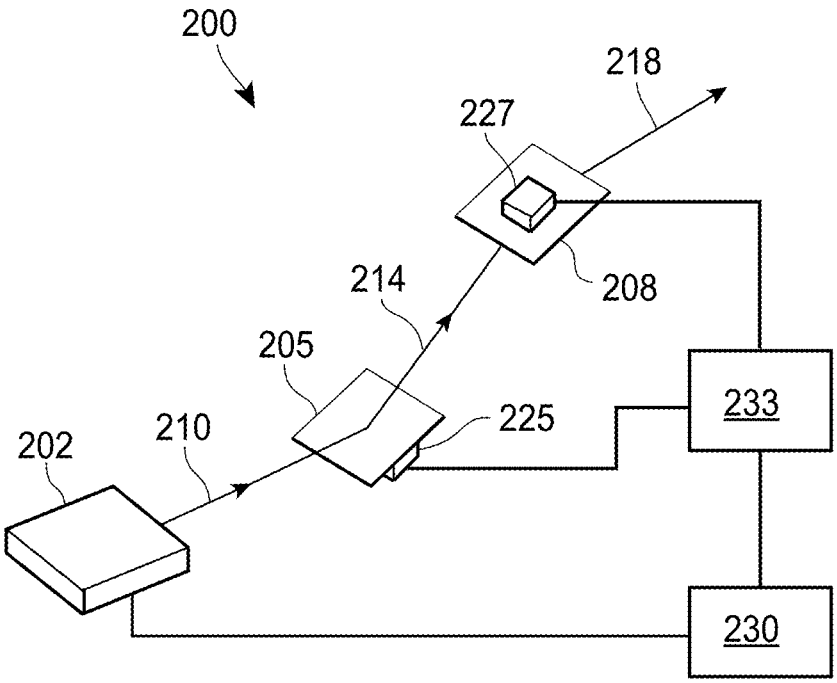
FIG. 2 illustrates an example embodiment of a system for a dual-diffraction element monochromator as a double-crystal monochromator (DCM).

A monochromator that includes two diffracting elements is commonly referred to as a double-crystal monochromator, although any suitable diffracting elements may be used. FIG. 2 illustrates an example embodiment of a system for a tunable dual-diffraction element monochromator referred to as a double-crystal monochromator (DCM) 200 as described herein. The DCM 200 includes a radiation source 202, a first diffraction element 205, and a second diffraction element 208. While described as a DCM for convenience, the first and second diffraction elements 205 and 208 of the monochromator 200 may each independently be a crystal substrate, multilayer material, grating, or other diffractive element. The radiation source 202 provides radiation in the form of an input beam 210 to the first diffraction element 205. The first diffraction element 205 is configured to reflect the input beam 210 as a reflected beam 214. The input beam 210 has an input beam vector characterized by an angle of incidence of the input beam 210 on the first diffraction element 205, discussed further herein. The reflected beam 214 is then provided to the second diffraction element 208, and the second diffraction element 208 is configured to reflect the reflected beam 214 as an output beam 218. The reflected beam 214 has a reflected beam vector characterized by an angle of incidence of the reflected beam 214 on the second diffraction element 208, discussed further herein.

In embodiments, the radiation source 202 may include a bend magnet, an undulator, a wiggler, a cyclotron, a synchrotron, a free electron laser (FEL), a laboratory x-ray source, a gamma ray source, a linear accelerator (LINAC), a higher order harmonic generation source, or another radiation source. By way of example and not limitation, the radiation source 202 may be configured to provide an input beam 210 having energies of 1 to 10 keV, 3 to 30 keV, 5 to 20 keV, 5 to 50 keV, or energies, or ranges of energies, including energies greater than 50 keV. Specifically, the radiation source 202 may be configured to provide radiation having an energy, or range of energies, in the x-ray regime. In embodiments, the radiation source 202 may also include optics for forming the input beam 210. Such optics may include a collimator, frequency content filter, spatial filter, lens, mirror, grating, dispersive element, aperture, or other optical element for forming the input beam 210.

The first and second diffraction elements 205 and 208 may independently be diamond, silicon, quartz, germanium, or any crystal, multilayer material, grating, or other material that can diffract radiation. Further, the first and second diffraction elements 205 and 208 may be perfect crystals, mosaic crystals, or crystals under strain. Still further, the first and second diffraction elements 205 and 208 may be a same material, or the first and second diffraction elements 205 and 208 may be different materials. In embodiments, the first and second diffraction elements 205 and 208 may be in Bragg or Laue geometry. The first and second diffraction elements 205 and 208 may include a ruled grating, a holographic grating, a reflective grating, a transmissive grating, a polarization grating, an echelle grating, or another grating capable of diffracting radiation.

Also by way of example and without limitation, the output beam 218 may have a peak energy of 5 keV, 10 keV, 15 keV, 25 keV, between 5 and 25 keV, between 20 and 30 keV, between 3 and 50 keV, or greater than 50 keV. In general, the output beam 218 may have an energy according to Bragg's Law capable of being diffracted by a crystal having a crystal lattice distance Band the radiation having an incident angle on the crystal lattice. In a simulated example, as discussed further herein in reference to FIGS. 6 through 8, the output beam 218 may have an energy between 3 and 50 keV. In embodiments, the output beam 218 may have an energy that is a harmonic of an energy of the input beam 210. The output beam 218 may have a peak energy in the X-ray regime that the radiation source 202 is configured to provide and that satisfies the Bragg equation EQ. 1 for a chosen crystal lattice d-spacing. In embodiments, the output beam may have any bandwidth that is within the energy range that the radiation source 202 is configured to provide. In the simulated example of FIGS. 6-8, the output beam 218 has a peak energy of 5 keV with a 0.24 eV bandwidth, or a peak energy of 10 keV with a 0.94 eV bandwidth for first and second diffraction elements 205 and 208 of diamond (111) crystal.

In embodiments, the DCM 200 may further include a first mount 225 physically coupled to the first diffraction element 205, with the first mount 225 configured to rotate the first diffraction element 205. Further described below, the first mount 225 may be configured to rotate the first diffraction element 205 about the input beam vector. Further, the DCM 200 may include a second mount 227 physically coupled to the second diffraction element 208, with the second mount 227 configured to rotate the second diffraction element 208. Further described below, the second mount 227 may be configured to rotate the second diffraction element 208 about the reflected beam 214 (i.e., the reflected beam vector) and the input beam 210 (i.e., the input beam vector). Further, the second mount 227 may include a translation stage for translating the second diffraction element 208 in three-dimensional Cartesian space.

The first and second mounts 225 and 227 may each independently include a mirror mount, a grating mount, a kinematic mount, a diffraction grating mount, a rotary mount, a kinematic grating mount adapter, a crystal mount, a servomotor, a linear actuator, a voice coil motor, a rotary actuator, a manual actuator, an electric actuator, or another mount and/or motor capable of changing the physical position and/or orientation of the first and second diffraction elements 205 and 208 respectively.

The monochromator 200 may further include a processor 230 and a controller 233. The controller 233 may be in communication with the first and second mounts 225 and 227 with the controller 233 configured to control the first and second mounts 225 and 227 to change the positions and/or orientations of the first and second substrates 205 and 208. The processor 230 may include a memory that stores machine-readable instructions. The processor 230 may execute the machine-readable instructions to perform the methods described herein. The processor 230 may determine physical parameters of the first and/or second diffraction element 205 and 208 and the processor 230 may provide the parameters to the controller 233. The physical parameters may include a position in three-dimensional Cartesian or polar space, a rotational coordinates of the first diffraction element 205, rotational coordinates of the second diffraction element 208, another physical orientation parameter, another physical translational parameter, or another spatial parameter. The controller 233 may control the first and second mounts 225 and 227 to change the physical position and/or orientations of the first and/or second diffraction elements 205 and 208 according to the physical parameters provided by the processor 230. The controller 233 may control the first and second mounts 225 and 227 to change the energy and/or exit angle of the output beam 218.

In embodiments, the processor 230 may provide the controller 233 with a current status of the first and/or second diffraction elements 205 and 208. For example, the processor 230 may store in memory a previous set of parameters that the processor 230 provided to the controller 233, with the previous set of parameters representing a current physical state of the first and/or second diffraction elements 205 and 208. Alternatively, the controller 233 may store, in a memory, parameters of the current state of the first and/or second diffraction elements 205 and 208 and the controller 205 and 208 may provide the current state parameters to the processor 230. The parameters of the current state of the first and/or second diffraction element 205 and 208 may include current rotational coordinates, current position coordinates, current translational coordinates, three-dimensional Cartesian coordinates, three-dimensional polar coordinates, or another current physical parameter. In embodiments, the first and/or second mount 225 and 227 may each provide feedback to the controller 233, with the feedback being indicative of the current state of the first and second diffraction element 205 and 208 respectively. For example, the controller 233 may control the first crystal mount 225 to rotate or move the first diffraction element 205 to a desired physical orientation. Over time, the first crystal mount 225 may physically drift due to temperature changes, environmental changes, movement of a the DCM 200, new installation of the DCM 200, powering down of the DCM 200, physical shock to the first mount 225, physical shock to the DCM 200, or drift over time due to another factor. The controller may then retrieve from the first mount information pertaining to the current physical state of the first crystal mount 225 and first diffraction element 205 to correct for any shift or drift of the first crystal mount 225. The controller 233 may provide the current state parameters to the processor 230, and the processor 230 may use the current state parameters to determine target parameters for a desired future state of the first and second diffraction elements 205 and 208. The processor 230 may provide the determined target parameters to the controller 233 and the controller 233 may control the first and/or second crystal mounts 225 and 227 to change the physical orientation of the first and second diffraction elements 205 and 208 according to the provided parameters. The target parameters may include target rotational coordinates, target position coordinates, target translational coordinates, three-dimensional Cartesian coordinates, three-dimensional polar coordinates, or another spatial coordinate.

Figure 3:
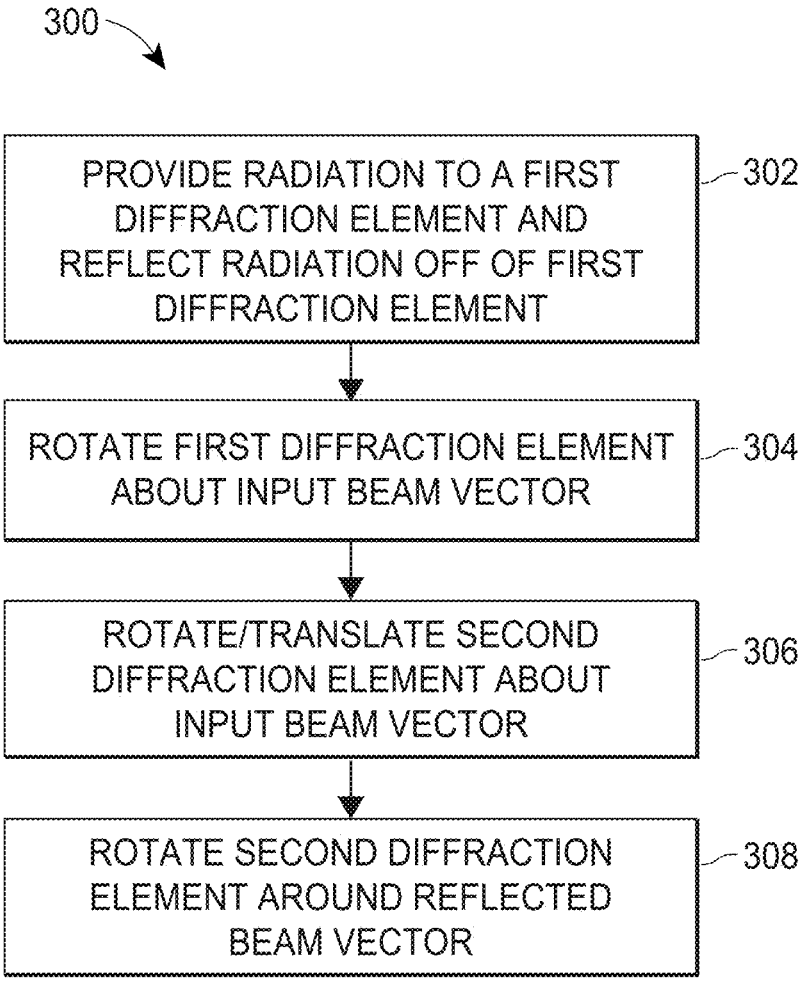
FIG. 3 is a flow diagram of a method for tuning the energy of an output beam of a monochromator while maintaining a fixed output beam exit angle.
Figure 4C:
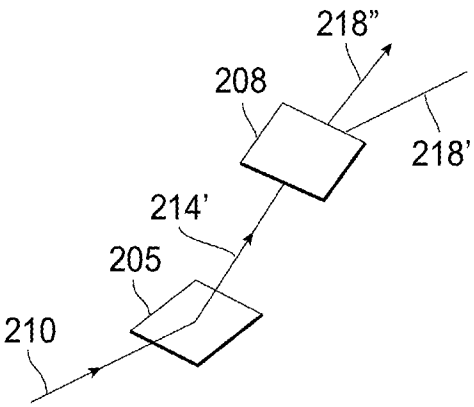
FIG. 4C illustrates a tuned optical configuration of diffraction elements of the monochromator of FIG. 2 according to the method of FIG. 3.
Figure 4B:
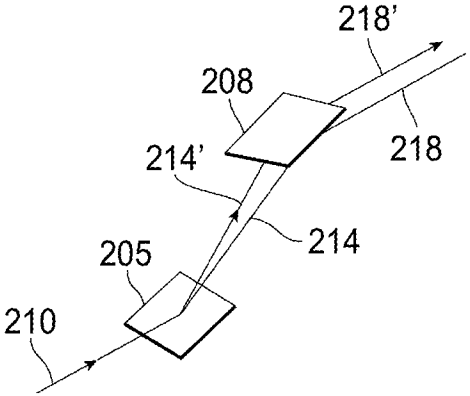
FIG. 4B illustrates an intermediate optical configuration of diffraction elements of the monochromator of FIG. 2 according to the method of FIG. 3.
Figure 4A:
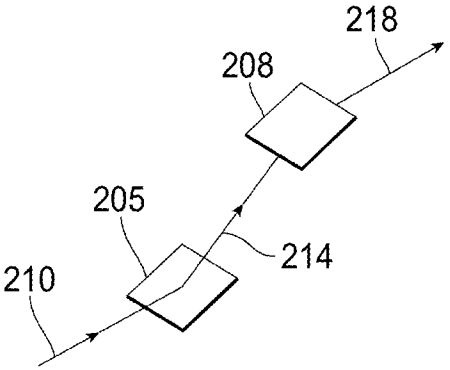
FIG. 4A illustrates an initial optical configuration of diffraction elements of the monochromator of FIG. 2 according to the method of FIG. 3.

FIG. 3 is a flow diagram of a method 300 for tuning the energy of an output beam of a monochromator, while maintaining a fixed output beam exit angle. The method of FIG. 3 may be performed by the monochromator 200 of FIG. 2. FIGS. 4A-4C respectively illustrate optical configurations 400A, 400B, and 400C of the first and second diffraction elements 205 and 208 of the monochromator 200 of FIG. 2 for performing the energy tuning method 300 of FIG. 3. Referring simultaneously to FIG. 3 and FIGS. 4A-4C, the method 300 includes, providing radiation to the first diffraction element 210, the provided radiation being the input beam 210 (block 302). The first diffraction element 210 is configured to reflect the radiation as the reflected beam 214. The reflected beam 214 is incident on the second diffraction element 208, and the second diffraction element 208 is configured to reflect the reflected beam 214 as the output beam 218.

The method 300, further includes rotating the first diffraction element 205 around the input beam vector (block 304). The input beam vector is defined by the propagation axis of the input beam 210, and more specifically, by the vector defined by the incidence point, and angle of incidence of the input beam 210 on the first diffraction element 205. The first diffraction element 302 is rotated around the input beam vector by a first angular value $\alpha$. The resultant angle of the first diffraction element 205, after rotating the first diffraction element 205, reflects the input beam 210 as a tuned reflected beam 214'.

The second diffraction element 208 is rotated about the input beam vector (block 306) by the first angular value $\alpha$. In embodiments, rotating the second diffraction element 208 around the input beam vector may include rotating the second diffraction element 208 on one or more rotational axes in Cartesian coordinate space, polar coordinate space, or another three-dimensional coordinate space. Additionally, in embodiments, rotating the second diffraction element 208 around the input beam vector may include translating the second diffraction element 208 in one or more spatial dimensions. In any embodiments, the second diffraction element 208 is physically manipulated and spatially configured to rotate around the input beam vector. The resultant angle of the second diffraction element 208, after rotating the second diffraction element 208 around the input beam vector, reflects the tuned reflected beam 214' as an intermediate output beam 218'.

The method further includes, rotating the second diffraction element 208 about a reflected beam vector of the tuned reflected beam 214' (block 308). The second diffraction element 208 is rotated about the tuned reflected beam 214' that is incident on the second diffraction element 208 after the first and second diffraction elements 205 and 208 have been rotated about the input beam vector. The reflected beam vector of the tuned reflected beam 214' is defined by the propagation axis of the tuned reflected beam 214', and more specifically, by the vector defined by the incidence point, and angle of incidence of the tuned reflected beam 214' on the second diffraction element 208. The second diffraction element 208 is rotated about the reflected beam vector by a second angular value A. After the rotation of the second diffraction element 208 about the reflected beam vector, the second diffraction element 208 reflects the tuned reflected beam 214' as a tuned output beam 218". In embodiments, the second diffraction element 208 may be moved closer to, or further from, the first diffraction element 205 to change the point of incidence of the tuned reflected beam 214' on the second diffraction element 208, which changes the output location of the tuned output beam 218". The distance between the second diffraction element 208 and the first diffraction element 205 may be determined by a desired energy of the tuned output beam 218".

As illustrated in FIG. 2, the first and second diffraction elements 205 and 208 may be physically coupled to first and second mounts 225 and 227 which respectively control the physical position and orientation of each of the first and second diffraction element 205 and 208. The first and second mounts 225 and 227 may be controlled by the controller 233 to perform steps of the method 300 of FIG. 3. Additionally, the processor 230 may provide the controller 233 with identified or otherwise calculated physical parameters (e.g., physical coordinates, rotation angles, Cartesian coordinates, polar coordinates, etc.) for the controller 223 to control the first and second mounts 225 and 227. Without limitation, the first and second mounts 225 and 227 may be configured to rotate the first and/or second diffraction element 205 and 208 by an angle of 0.01 degrees, 0.02 degrees, 0.05 degrees, 1 degree, between 0.01 and 1 degree, between 1 and 5 degrees, or greater than 5 degrees. The first and second mounts 225 and 227 may be configured to operate with an angular resolution of 0.0001°, a position resolution of 0.05 mm, an angular range to tune the output beam from 5 to 25 keV, an angular range to tune the incidence angle of the input beam between 7° and 37°, an angular range of rotation about the input beam vector of the input beam 210 of between 3° and 56°, an angular range of rotation about the reflected beam 214 of between 24° and 114°, a translation range of 50 mm along an axis defined by the input beam vector, and a translation range of 10 mm in directions orthogonal to the input beam vector.

Tuning of the input beam 210 propagating through the monochromator must be performed while preserving the Bragg condition for diffraction. That is, the radiation is scattered in a specular manner by the first and second diffraction elements 205 and 208 that satisfies the condition described by the Bragg Equation, EQ. 1. Rotating the first diffraction element 205 about the input beam vector preserves the Bragg condition, and rotating the second diffraction element 208 about the tuned reflected beam 214' (i.e., the reflected beam vector) also preserves the Bragg condition. Additionally, rotation of an entire optical system about the input beam vector preserves the Bragg condition. The described rotations are examples of rotations that preserve the Bragg condition, in embodiments, other rotations and physical configurations may also be implemented that preserve the Bragg condition.

The first and second angular values α and β may be determined by a desired or required energy of the tuned output beam 218" and/or a desired beam exit angle. The input beam has an angle of incidence of e on the first diffraction element 205, and the reflected beam has an angle of incidence of e on the second diffraction element 208. As an example, the first and second diffraction elements 205 and 208 may be crystal substrates with a crystal lattice spacing distance of d. The output energy of the tuned output beam 218" of the crystal monochromator is then determined by the crystal lattice spacing d and the angle of incidence e of the input beam. Therefore, for a given crystal substrate, the angle of incidence e may be determined by the desired energy, or energies, of the output beam. As would be understood by a person of ordinary skill in the art, the output energy and corresponding calculations for other diffraction elements (i.e., multilayer materials, gratings, etc) may be similarly derived as described herein.

In an example, an output beam may already be tuned to have a desired energy, but a different exit angle may be required. The following is an example of how to steer an output beam of a desired energy to a new exit angle by determining the angular values α and β and performing the method 300 of FIG. 3 using the determined angular values α and β. Using three-dimensional Cartesian space with vector notation (X, Y, Z), the input beam vector is taken as a reference with the input beam 210 traveling entirely in the Z direction. Therefore, the input beam vector, $V_1$, is:

$$V_1=(0,0,1). \quad \text{EQ. 2}$$

The reflected beam 214 has a photon energy, which is reflected from the first diffraction element 205 by a 2θ angle relative to the incident beam 210, the reflected beam 214 has a reflected beam vector of:

$$V_2=(0, \sin 2\theta, \cos 2\theta). \quad \text{EQ. 3}$$

The rotation of the first diffraction element 205 about the input beam vector by the first angular value α, as performed in the method 300 of FIG. 3, is described by the rotation operation R, which results in the tuned reflected beam 214', $V_2'$, as described by:

$$V_2'=R(\alpha,(0,0,1))V_2, \quad \text{EQ. 4}$$

$$V_2'=(\sin 2\theta\cdot\sin \alpha, \sin 2\theta\cdot\cos \alpha, \cos 2\theta). \quad \text{EQ. 5}$$

Figure 5:
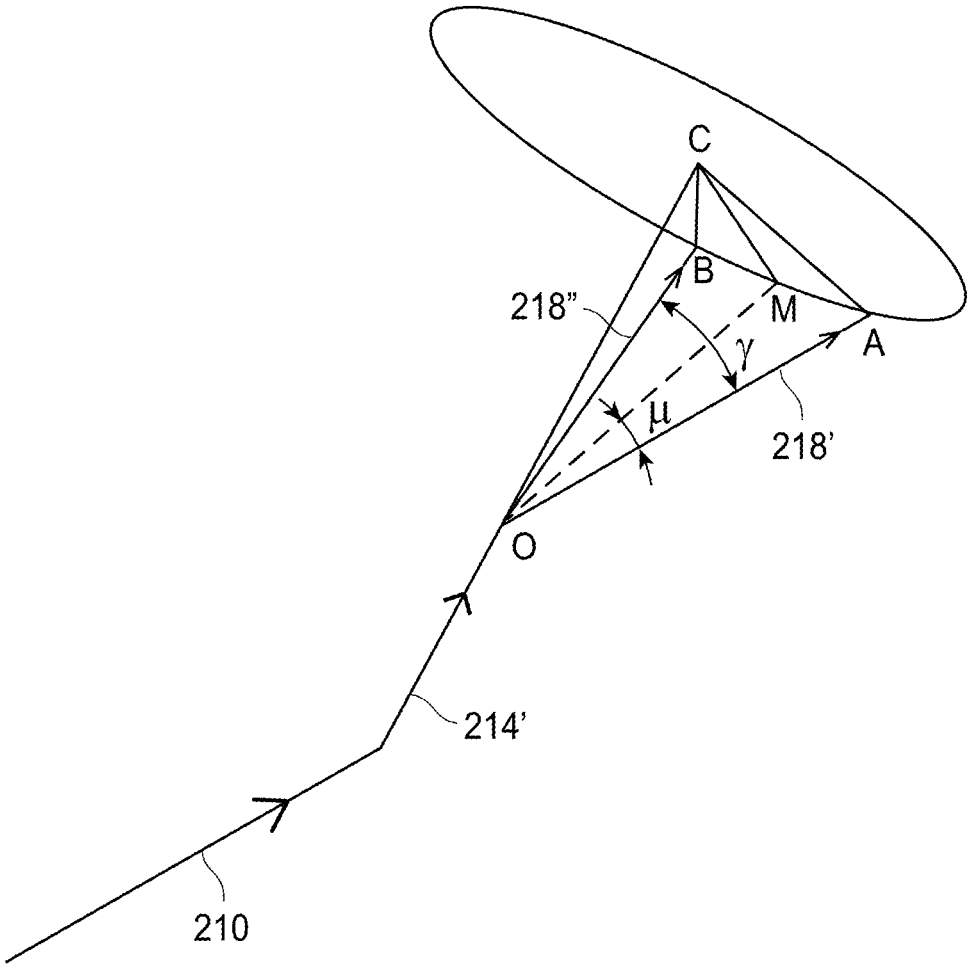
FIG. 5 is a vector diagram illustrating a beam trajectory having a fixed exit angle $\gamma$ for calculating the rotational angular values $\alpha$ and $\beta$ for tuning the output energy of a monochromator.

FIG. 5 is a vector diagram illustrating a beam trajectory having an exit angle γ for calculating the rotational angular values α and β for tuning the output energy of a monochromator while maintaining a fixed exit angle. The determination of angular values α and β for tuning the output energy of a monochromator while maintaining a fixed exit angle as described herein. The circle shown in FIG. 5 is a representation of the rotation of the intermediate output beam 218' to the tuned output beam 218". FIG. 5 includes the tuned reflected beam 214' after the rotation of the first substrate 205. The angle μ is defined as the angle from the tuned reflected beam 214' to the YZ-plane (∠AOM in FIG. 5) which defines the relationship between the photon energy and the angular value α as:

$$\tan \mu=\tan 2\theta\cdot\sin \alpha \quad \text{EQ. 6}$$

with the angle μ also being equal to half of the exit angle γ of the tuned output beam 218", with the angle γ being ∠AOB in FIG. 5. The angle ∠OCA is 90°, and therefore, the angular values α and β can be determined by the equations:

$$\sin\left(\frac{\beta}{2}\right) = \sin\left(\frac{\gamma}{2}\right)/\sin 2\theta, \quad \text{EQ. 7}$$

$$\sin\alpha = \frac{\tan\left(\frac{\gamma}{2}\right)}{\tan 2\theta}. \quad \text{EQ. 8}$$

As shown by EQs. 7 and 8, the angular values α and A used in the method 300 of FIG. 3 are dependent on the output beam energy, and the desired exit angle γ. In embodiments, a further condition to consider is that it may be desirable for the tuned output beam 218" to propagate collinearly in the horizontal plane (XZ) plane with input beam. Collinear propagation in the XY plane prevents any requirement of tilting down beam components to match a beam exit angle which is often difficult due to heavy equipment and bulky setups.

In an example of the DCM 200 as described herein, the first and second diffraction elements 205 and 208 may be diamond (111) crystal substrates. FIG. 6 is a table of the angular a and A values for a monochromator configuration with various output beam energies with a fixed exit angle of 23.13 degrees. The values presented in FIG. 6 are for a diamond (111) crystal substrate. The energies reported by the table of FIG. 6 demonstrate that the output beam energy of a monochromator, as described herein, can be continuously tunable from 5 to 25 keV while maintaining a constant exit angle. In embodiments, the first and second diffraction elements 205 and 208 may be materials other than diamond (111) and the resultant monochromators may exhibit output beam energy ranges from 8 to keV.

Figure 7A:
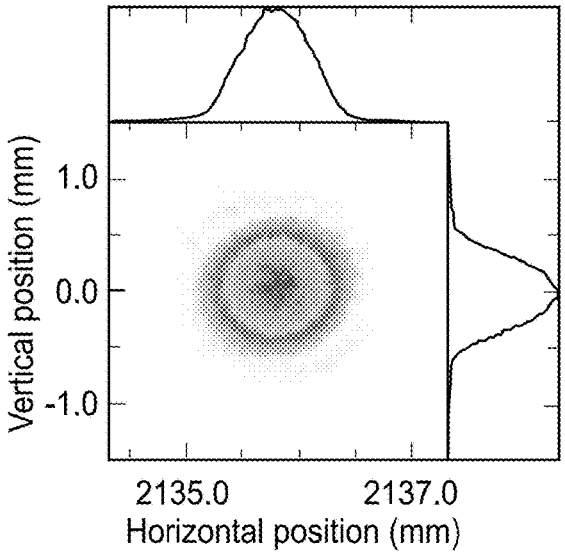
FIG. 7A is a simulated beam profile plot for a diamond based tunable monochromator using parameter values from the table of FIG. 6 and having an output beam energy of 5 keV.
Figure 7B:
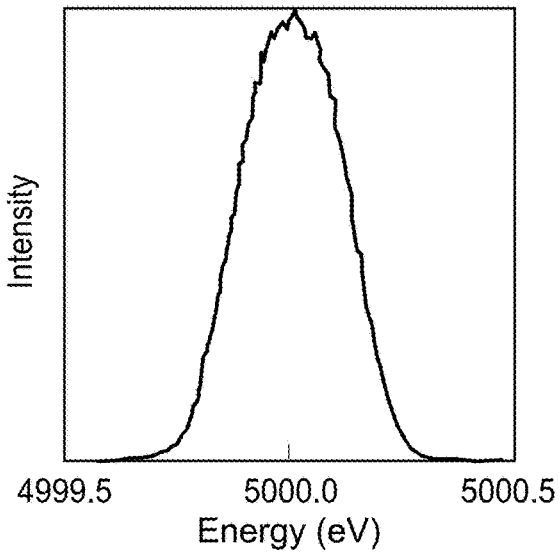
FIG. 7B is a plot of the energy spectrum of the simulated output beam of FIG. 7A.
Figure 7C:
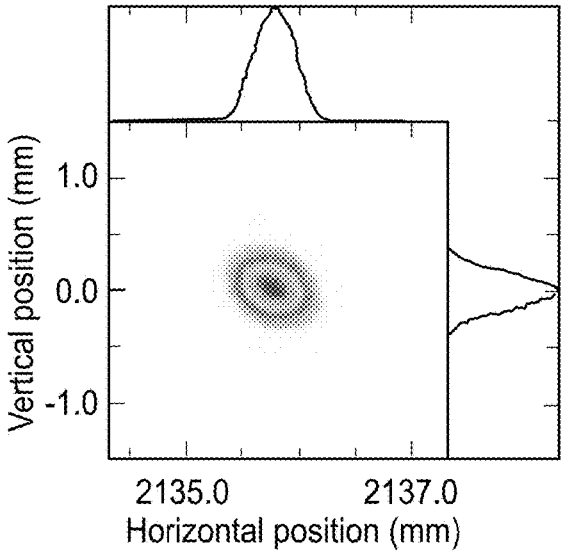
FIG. 7C is a simulated beam profile plot for a diamond based tunable monochromator using parameter values from the table of FIG. 6 and having an output beam energy of 15 keV.
Figure 7D:
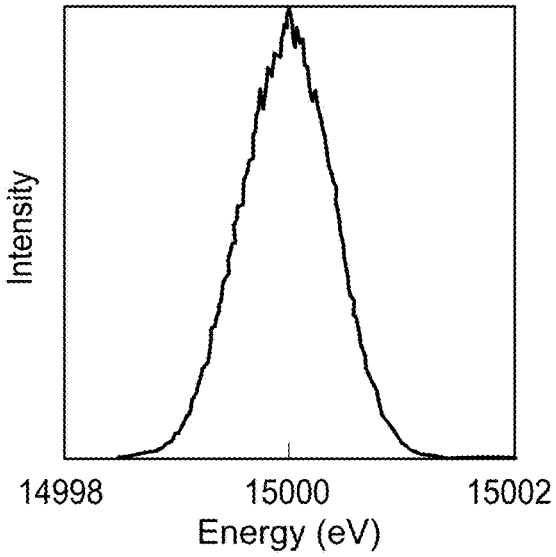
FIG. 7D is a plot of the energy spectrum of the simulated output beam of FIG. 7C.

FIGS. 7A and 7C are simulated beam profile plots for a DCM having the parameter values from the table of FIG. 6 with diamond (111) as the first and second diffraction elements 205 and 208. The simulations for generating the plots of FIGS. 7A and 7C were performed using ray tracing. The source of radiation for the simulations was an undulator having a period of 18.5 millimeters and 70 periods, and the source of radiation was a distance of 28.3 meters from the monochromator. The simulated radiation source, and any physically implementable radiation source, may provide energies from 5 keV to 100 keV with bandwidths on the order of 1 to 8 percent of the peak energy. FIGS. 7C and 7D are the energy spectrums of the simulated output beams of the DCM configurations of FIGS. 7A and 7B respectively. FIGS. 7A and 7B present the results for a DCM output beam having a peak energy of 5 keV, while the FIGS. 7C and 7D present the results for a DCM output beam having a peak energy of 15 keV. FIG. 7E is a table of parameters including the flux, intensity, and spatial distribution parameters of the results of the simulations of FIGS. 7A-7F with additional parameters for a 10 keV beam. The output beam of FIGS. 7C and 7D has an energy three times greater than the output beam of FIGS. 7A and 7B, which is the third harmonic of the output beam of FIGS. 7A and 7B showing that the DCM described herein may be useful for performing harmonic measurements and procedures in industry and experimental setups. The results of the simulation verify that the disclosed methods for fixed exit-angle tuning of a monochromator operate as proposed herein.

FIGS. 7A and 7C show that the output beams exhibit first order spatial modes having a peak at the same horizontal and vertical location (i.e., the beams have a fixed output angle), while FIGS. 7B and 7D show the different energies of the tuned output beams. The reduction in radiant flux shown by FIG. 7D is due to the angular bandwidth of the diamond crystals and the dispersive geometry of the simulated dual-crystal monochromator. The higher energy output beam of FIGS. 7C and 7D requires greater incidence angles, which may also result in loss of flux through polarization effects.

The disclosed dual crystal monochromator exhibits improved polarization distortion as compared to typical monochromators. The polarization rotation of the input beam to the output beam can be calculated as:

$$P_r=\beta-\beta'-\alpha \qquad \text{EQ. 9}$$

where $P_r$ is the polarization rotation, $\alpha$ and $\beta$ are the rotation angular values described previously, and $\beta'$ is the angular value between the resulting output beam polarization and a surface plane of the second diffraction element 208. FIG. 8 is a table of polarization factor values for the disclosed DCM, $P_r$, and polarization factor values for a typical single crystal monochromator, $P_{SCM}$, at a variety of photon energies. The values presented by FIG. 8 show that the polarization factor of the disclosed dual crystal monochromator is less than the polarization factor due to a typical single crystal monochromator for output beam energy values from 5 keV to nearly 25 keV. The polarization factor is a ratio of the difference of the output intensity to the input intensity due to polarization. In embodiments, the polarization factor of a monochromator, as described herein, may have a polarization factor of 0.9 or greater, 0.8 or greater, or greater than 0.5, which corresponds to maximum intensity losses, due to polarization, of 10%, 20%, and 50% respectively. The disclosed monochromator may have a polarization factor that is greater than the polarization factor of a single bounce monochromator having the same beam exit angle.

The following list of aspects reflects a variety of the embodiments explicitly contemplated by the present disclosure. Those of ordinary skill in the art will readily appreciate that the aspects below are neither limiting of the embodiments disclosed herein, nor exhaustive of all of the embodiments conceivable from the disclosure above, but are instead meant to be exemplary in nature.

1. A beam steering system for a tunable monochromator, the system comprising: a first diffraction element configured to reflect, as a reflected beam, an input beam incident on a surface of the first diffraction element, the input beam having an input beam vector, the first diffraction element rotatable about the input beam vector, and the reflected beam having a reflected beam vector; and a second diffraction element configured to reflect, as an output beam having a beam exit angle, the reflected beam incident on a surface of the second diffraction element, and the second diffraction element rotatable about both the input beam vector and the reflected beam vector.

2. The beam steering system of aspect 1, wherein the first diffraction element and the second diffraction element each comprise crystal.

3. The beam steering system of either aspect 1 or 2, wherein the first diffraction element and the second diffraction element each comprise diamond (111) crystal.

4. The beam steering system of aspect 1, wherein the first diffraction element and the second diffraction element each comprise a multilayer.

5. The beam steering system of aspect 1, wherein the first diffraction element and the second diffraction element each comprise a grating.

6. The beam steering system of any of aspects 1 to 5, wherein the first diffraction element and the second diffraction element comprise a same material.

7. The beam steering system of aspect 2, wherein the first diffraction element comprises one of silicon, quartz, lithium fluoride, indium antimonide, germanium, graphite, or sapphire.

8. The beam steering system of aspect 2, wherein the second diffraction element comprises one of silicon, quartz, lithium fluoride, indium antimonide, germanium, graphite, or sapphire.

9. The beam steering system of any of aspects 1 to 8, wherein the input beam has an energy between 3 keV and 30 keV.

10. The beam steering system of any of aspects 1 to 8, wherein the output beam has an energy of 5 keV, 10 k eV, 15 keV, 25 keV, between 5 and 25 keV, or between 20 and 30 keV.

11. The beam steering system of any of aspects 1 to 8, wherein the output beam has an energy in the x-ray radiation range.

12. The beam steering system of any of aspects 1 to 11, wherein the output beam has an energy that is a harmonic of an energy band of the input beam.

13. The beam steering system of any of aspects 1 to 12, wherein the beam exit angle is a fixed angle.

14. The beam steering system of any of aspects 1 to 13, wherein the polarization-dependent intensity loss of the beam steering system is less than 10%.

15. The beam steering system of any of aspects 1 to 14, further comprising: a first mount physically coupled to the first diffraction element, the first mount configured to rotate the first diffraction element about the input beam vector; and a second mount physically coupled to the second diffraction element, the second mount configured to rotate the second diffraction element about the input beam vector and the reflected beam vector.

16. The beam steering system of aspect 15, further comprising a three-axis translation stage physically coupled to the second diffraction element, the three-axis translation stage configured to translate the second diffraction element in three orthogonal directions.

17. The beam steering system of aspect 16, further comprising: a controller communicatively coupled to (i) the first mount, the controller configured to control the rotation of the first diffraction element, (ii) the second mount, the controller configured to control the rotation of the second diffraction element, and (iii) the three-axis translation stage, the controller configured to control the position of the second diffraction element; and a processor communicatively coupled to the controller, the processor configured to provide the controller with (i) rotational coordinates of the first diffraction element, (ii) rotational coordinates of the second diffraction element, and (iii) translational coordinates of the second diffraction element.

18. The beam steering system of aspect 17, wherein the rotational coordinates of the first diffraction element comprise a current rotational coordinate of the first diffraction element, the rotational coordinates of the second diffraction element comprise a current rotational coordinate of the second diffraction element, and the translational coordinates of the second diffraction element comprise a current translational coordinate of the second diffraction element.

19. The beam steering system of either aspect 17 or 18, wherein the rotational coordinates of the first diffraction element comprise a target rotational coordinate of the first diffraction element, the rotational coordinates of the second diffraction element comprise a target rotational coordinate of the second diffraction element, and the translational coordinates of the second diffraction element comprise a target translational coordinate of the second diffraction element.

20. The beam steering system of any of aspects 1 to 19, wherein the first diffraction element is physically configured such that the input beam has an angle of incidence on the first diffraction element, with the angle of incidence being determined by a desired energy of the output beam.

21. A method for tuning output beam energy of a tunable monochromator, the method comprising: rotating a first diffraction element around an input beam vector by a first angle value, the first diffraction element configured to reflect, as a reflected beam having a reflected beam vector, an input beam having the input beam vector; rotating a second diffraction element around the input beam vector by the first angle value; rotating the second diffraction element around the reflected beam vector by a second angle value, the second diffraction element configured to reflect, as an output beam, the reflected beam.

22. The method of aspect 21, wherein the first diffraction element and the second diffraction element each comprise crystal.

23. The method of either aspect 21 or 22, wherein the first diffraction element and the second diffraction element each comprise diamond (111) crystal.

24. The method of aspect 21, wherein the first diffraction element and the second diffraction element each comprise a multilayer.

25. The method of aspect 21, wherein the first diffraction element and the second diffraction element each comprise a grating.

26. The method of any of aspects 21 to 25, wherein the first diffraction element and the second diffraction element comprise a same material.

27. The method of aspect 22, wherein the first diffraction element comprises one of silicon, quartz, lithium fluoride, indium antimonide, germanium, graphite, or sapphire.

28. The method of aspect 22, wherein the second diffraction element comprises one of silicon, quartz, lithium fluoride, indium antimonide, germanium, graphite, or sapphire.

29. The method of any of aspects 21 to 28, wherein the input beam has an energy between 3 keV and 30 keV.

30. The method of any of aspects 21 to 28, wherein the output beam has an energy of approximately 5 keV, 10 k eV, 15 keV, 25 keV, between 5 and 25 keV, or between 20 and 30 keV.

31. The method of any of aspects 21 to 28, wherein the output beam has an energy in the x-ray radiation range.

32. The method of any of aspects 21 to 31, wherein the output beam has an energy that is a harmonic of an energy band of the input beam.

33. The method of any of aspects 21 to 32, wherein the output beam has a fixed beam exit angle.

34. The method of any of aspects 21 to 33, wherein the polarization-dependent loss between the input and output beams is less than 10%.

35. The method of any of aspects 21 to 34, further comprising: rotating, by a first mount physically coupled to the first diffraction element, the first diffraction element about the input beam vector; and rotating, by a second mount physically coupled to the second diffraction element, the second diffraction element about the input beam vector and the reflected beam vector.

36. The method of aspect 35, further comprising translating, by a three-axis translation stage physically coupled to the second diffraction element, the second diffraction element.

37. The method of aspect 36, further comprising: a controller communicatively coupled to (i) the first mount, (ii) the second mount, and (iii) the three-axis translation stage, the controller configured to: control the rotation of the first diffraction element; control the rotation of the second diffraction element; and control the position of the second diffraction element; and; provide, by a processor communicatively coupled to the controller, the controller with (i) rotational coordinates of the first diffraction element, (ii) rotational coordinates of the second diffraction element, and (iii) translational coordinates of the second diffraction element.

38. The method of aspect 37, wherein the rotational coordinates of the first diffraction element comprise a current rotational coordinate of the first diffraction element, the rotational coordinates of the second diffraction element comprise a current rotational coordinate of the second diffraction element, and the translational coordinates of the second diffraction element comprise a current translational coordinate of the second diffraction element.

39. The method of either aspect 37 or 38, wherein the rotational coordinates of the first diffraction element comprise a target rotational coordinate of the first diffraction element, the rotational coordinates of the second diffraction element comprise a target rotational coordinate of the second diffraction element, and the translational coordinates of the second diffraction element comprise a target translational coordinate of the second diffraction element.

40. The method of any of aspects 21 to 39, further comprising: positioning the first diffraction element such that the input beam has an angle of incidence on the first diffraction element, with the angle of incidence being determined by a desired energy of the output beam.

41. The method of any of aspects 21 to 40, further comprising: positioning the second diffraction element such that the reflected beam has an angle of incidence on the second diffraction element, with the angle of incidence being determined by a desired energy of the output beam.

What is claimed is:

1. A beam steering system for a tunable monochromator, the system comprising:

a first diffraction element configured to reflect, as a reflected beam, an input beam incident on a surface of the first diffraction element, the input beam having an input beam vector, the first diffraction element rotatable about the input beam vector, the reflected beam having a reflected beam vector; and a second diffraction element configured to reflect, as an output beam having a beam exit angle, the reflected beam incident on a surface of the second diffraction element, and the second diffraction element rotatable about both the input beam vector and the reflected beam vector.

2. The beam steering system of claim 1, wherein the first diffraction element and the second diffraction element each comprise crystal.

3. The beam steering system of claim 1, wherein the first diffraction element and the second diffraction element each comprise a multilayer.

4. The beam steering system of claim 1, wherein the first diffraction element and the second diffraction element each comprise a grating.

5. The beam steering system of claim 1, wherein the output beam has an energy in the x-ray radiation range.

6. The beam steering system of claim 1, wherein the beam exit angle is a fixed angle.

7. The beam steering system of claim 1, further comprising:

a first mount physically coupled to the first diffraction element, the first mount configured to rotate the first diffraction element about the input beam vector; and a second mount physically coupled to the second diffraction element, the second mount configured to rotate the second diffraction element about the input beam vector and the reflected beam vector.

8. The beam steering system of claim 7, further comprising a three-axis translation stage physically coupled to the second diffraction element, the three-axis translation stage configured to translate the second diffraction element in three orthogonal directions.

9. The beam steering system of claim 8, further comprising:

a controller communicatively coupled to (i) the first mount, the controller configured to control the rotation of the first diffraction element, (ii) the second mount, the controller configured to control the rotation of the second diffraction element, and (iii) the three-axis translation stage, the controller configured to control the position of the second diffraction element; and a processor communicatively coupled to the controller, the processor configured to provide the controller with (i) rotational coordinates of the first diffraction element, (ii) rotational coordinates of the second diffraction element, and (iii) translational coordinates of the second diffraction element.

10. The beam steering system of claim 1, wherein the first diffraction element is physically configured such that the input beam has an angle of incidence on the first diffraction element, with the angle of incidence being determined by a desired energy of the output beam.

11. A method for tuning output beam energy of a tunable monochromator, the method comprising:

rotating a first diffraction element around an input beam vector by a first angle value, the first diffraction element configured to reflect, as a reflected beam having a reflected beam vector, an input beam having the input beam vector;

rotating a second diffraction element around the input beam vector by the first angle value;

rotating the second diffraction element around the reflected beam vector by a second angle value; and reflecting, by the second diffraction element, the reflected beam as an output beam having a beam exit angle.

12. The method of claim 11, wherein the first diffraction element and the second diffraction element each comprise crystal.

13. The method of claim 11, wherein the first diffraction element and the second diffraction element each comprise a multilayer.

14. The method of claim 11, wherein the first diffraction element and the second diffraction element each comprise a grating.

15. The method of claim 11, wherein the output beam has an energy in the x-ray radiation range.

16. The method of claim 11, wherein the output beam has a fixed beam exit angle.

17. The method of claim 11, further comprising:

rotating, by a first mount physically coupled to the first diffraction element, the first diffraction element about the input beam vector; and rotating, by a second mount physically coupled to the second diffraction element, the second diffraction element about the input beam vector and the reflected beam vector.

18. The method of claim 17, further comprising translating, by a three-axis translation stage physically coupled to the second diffraction element, the second diffraction element.

19. The method of claim 18, further comprising:

a controller communicatively coupled to (i) the first mount, (ii) the second mount, and (iii) the three-axis translation stage, the controller configured to:

control the rotation of the first diffraction element;

control the rotation of the second diffraction element; and control the position of the second diffraction element; and;

provide, by a processor communicatively coupled to the controller, the controller with (i) rotational coordinates of the first diffraction element, (ii) rotational coordinates of the second diffraction element, and (iii) translational coordinates of the second diffraction element.

20. The method of claim 11, further comprising:

positioning the first diffraction element such that the input beam has an angle of incidence on the first diffraction element, with the angle of incidence being determined by a desired energy of the output beam.

* * * * *